US008991219B2

(12) United States Patent
Hasanreisoglu

(10) Patent No.: US 8,991,219 B2
(45) Date of Patent: Mar. 31, 2015

(54) WASHING MACHINE WITH RESERVOIRS IN THE RIBS FOR BALANCING AND WASH SPRAYS

(76) Inventor: Levent Hasanreisoglu, Istanbul (TR)

( * ) Notice: Subject to any disclaimer, the term of this patent is extended or adjusted under 35 U.S.C. 154(b) by 1244 days.

(21) Appl. No.: 12/810,979

(22) PCT Filed: Nov. 27, 2008

(86) PCT No.: PCT/EP2008/066373

§ 371 (c)(1),
(2), (4) Date: Oct. 2, 2010

(87) PCT Pub. No.: WO2009/083352

PCT Pub. Date: Jul. 9, 2009

(65) Prior Publication Data

US 2011/0005277 A1 Jan. 13, 2011

(30) Foreign Application Priority Data

Dec. 28, 2007 (TR) ..... a 2007 09107

(51) Int. Cl.
*D06F 33/00* (2006.01)
*D06F 37/22* (2006.01)
*D06F 37/06* (2006.01)

(52) U.S. Cl.
CPC ..... *D06F 37/225* (2013.01); *D06F 37/065* (2013.01)
USPC ..... 68/12.06; 68/23.2; 68/142; 68/23.1; 68/139; 74/572.4

(58) Field of Classification Search
CPC ..... D06F 37/225; D06F 37/065; D06F 37/06; D06F 37/203; D06F 23/06
USPC ..... 68/12.06, 23.2, 139, 142, 23.1; 74/572.4
See application file for complete search history.

(56) References Cited

U.S. PATENT DOCUMENTS

2004/0082774 A1 4/2004 Guzaev et al.

FOREIGN PATENT DOCUMENTS

| | | | | |
|---|---|---|---|---|
| EP | 1094143 A | | 4/2001 | |
| EP | 1529866 A | | 5/2005 | |
| GB | 874922 | * | 7/1959 | |
| GB | 874922 A | | 8/1968 | |
| JP | 2002136792 A | * | 5/2002 | ..... D06F 33/02 |

OTHER PUBLICATIONS

Chikatoshi et al., "Drum type washing machine", JP 2002-136792, Machine Translation.*

* cited by examiner

*Primary Examiner* — Michael Barr
*Assistant Examiner* — Thomas Bucci
(74) *Attorney, Agent, or Firm* — Venjuris PC

(57) ABSTRACT

The present invention relates to a washing machine (1) that comprises a tub (2), a cylindrical drum (3) having a rear wall (7) wherein the items to be washed are emplaced, disposed coaxially inside the tub (2), one or more ribs (4) arranged on the inner periphery of the drum (3) and forming protrusions into the drum (3), a shaft (8) housed in the tub (2) that transfers the movement to the drum (3) and a bearing (9) situated at the center of the tub (2) rear wall (7), remaining stationary together with the tub (3), wherein the shaft (8) is housed, extending towards the center of the drum (3) and at least one water feeding line (10) situated inside the bearing (9) having an inlet connected to the mains water supply and an outlet opening outside the bearing (9).

20 Claims, 4 Drawing Sheets

WASHING MACHINE WITH RESERVOIRS IN THE RIBS FOR BALANCING AND WASH SPRAYS

Figure 1:
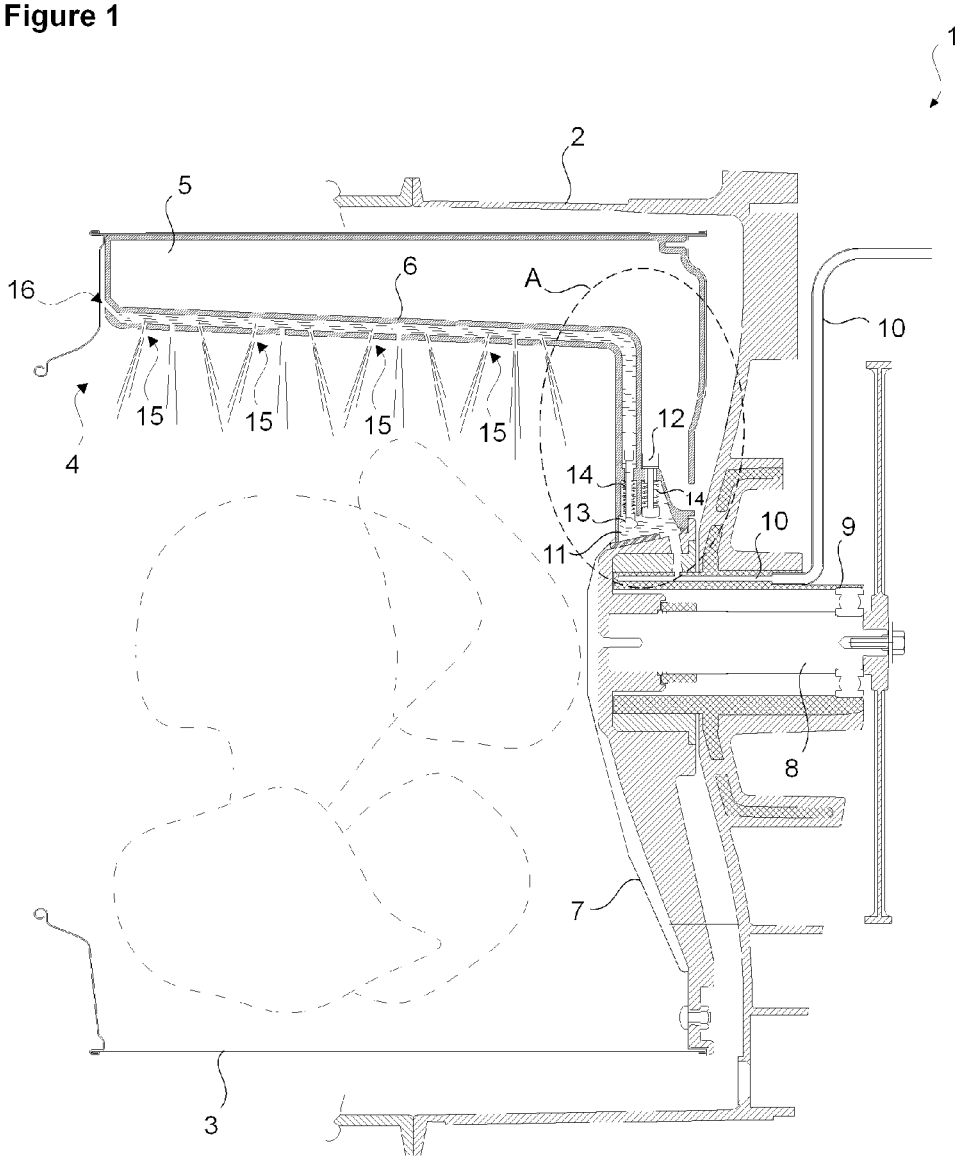

The present invention relates to a washing machine wherein the unbalanced load within the drum is balanced by using a fluid.

In washer/dryers, particularly in washing machines, the laundry is emplaced in a drum preferably rotating around a horizontal axis. In different steps of the washing program the laundry is cleaned with the help of water and detergent by rotating the drum at different speeds. While the drum is being rotated, the laundry is not distributed homogeneously within the drum and the laundry piles up in some regions causing an uneven load distribution. Particularly in the spinning step wherein the drum is being rotated at very high speeds, the unbalanced load distribution generates vibration. These vibrations not only generate noise and result in consumer dissatisfaction but also cause the machine to wear out. Moreover, the spinning performance at high speeds is adversely affected. Besides, in washing machines, in order to effectively soak the laundry in the washing step, water is delivered from above the drum unto the laundry by a method known as showering.

In the state of the art, a great number of solutions are developed for balancing the unbalanced load. Of these, a widely used solution is adding weights to the machine for increasing its inertia. However, since fixed weights make the transportation of the machine difficult, in some of the state of the art implementations, adding a fluid, mostly water, to the machine is suggested. Water is filled in the chambers secured on the tub or the drum. In a group of implementations, the fluid is added to the machine after transportation and the same fluid is used constantly. In another group of implementations, the fluid required for balancing is received into the machine during operation and discharged out at the end of the operation.

In the state of the art Japanese Patent Application no JP2002136792, an additional grooved element is described leaning on the shaft bearing that directs water to be delivered to the water storage tanks on the drum when there is unbalanced load. This additional element does not rotate and the water in the groove is delivered to the water storage tanks by means of a channel while the shaft bearing rotates.

In state of the art United States of America Patent Application no US20040082774, the explanation is given for balancing unbalanced load by delivering water to the ribs.

In state of the art Great Britain Patent Application no GB874922, a washing machine is explained wherein a striker valve is opened to release the water in the tub for compensating uneven weight distribution.

The aim of the present invention is the realization of a washing machine wherein unbalanced load is balanced and showering process is provided.

The washing machine realized in order to attain the aim of the present invention, explicated in the first claim and the respective claims thereof, comprises a balancing reservoir whereto water is delivered from the outlet of the feeding line in the drum shaft bearing for counterbalancing unbalanced load when load imbalance occurs during the spinning step and a rib having a showering reservoir whereto water is delivered from the outlet of the feeding line unto the laundry in the drum in the washing step.

In a washing machine wherein unbalanced load is counterbalanced by water, a more effective showering process can be performed without requiring an additional volume. The rib, without losing its basic function of mechanically agitating the laundry, is used both for the balancing process and the showering process. Thus, within the same rib volume, different functions can be performed at different times without occupying an extra space in the drum.

In another embodiment of the present invention, the washing machine comprises valves that open or close with the centrifugal effect depending on the rotational speed of the drum. One of the valves is in the open position in the washing step for delivering water to the showering reservoir and closes in the spinning step with the centrifugal effect. The other valve opens in the spinning step with the centrifugal effect and delivers water to the balancing reservoir corresponding to the unbalanced region. This valve closes when the speed of the drum falls below a certain speed, that is, in the washing step. In this embodiment of the present invention, when one valve closes, the other opens. Thus, only one function is activated at a time.

The balancing valve is disposed in the balancing reservoir whereas the showering valve is situated in the distribution chamber. By means of the valves, parallel to each other and arranged to face different directions, the forces acting on the valves in the same direction, opens one of the valves while closing the other. Thus, while the balancing valve opens with the centrifugal effect, the showering valve closes with the effect of the same centrifugal force.

In another embodiment of the present invention, the washing machine comprises a spring, with one end fastened to the valve and the other end to the outlet wherein the valve is mounted, for holding the valves at their initial positions. Thus, while the balancing valve remains in the closed position initially by means of the spring, the showering valve is in the open position by means of the spring. Thus the opening, closing times of the valves is regulated by adjusting the spring constants.

In another embodiment of the present invention, the washing machine comprises a discharge port formed at the end of the showering reservoir for discharging the water remaining in the showering reservoir.

By means of the present invention, in washing machines wherein the unbalanced load problem in the spinning step is eliminated by delivering water to the unbalanced load region from the shaft bearing, an extra space is not required since the ribs used as balancing volumes can also be used in performing the showering process that is activated in the washing step. By means of the present invention, these two systems energized at different times can be used within the same volume. Thus, volume loss in the drum is prevented. By means of the present invention, a more effective jet-showering system fed by a pump can be assembled for increasing washing effectiveness.

A washing machine realized in order to attain the aim of the present invention is illustrated in the attached figures, where:

FIG. 1—is the schematic view of a washing machine while showering process is performed in the washing step.

Figure 2:
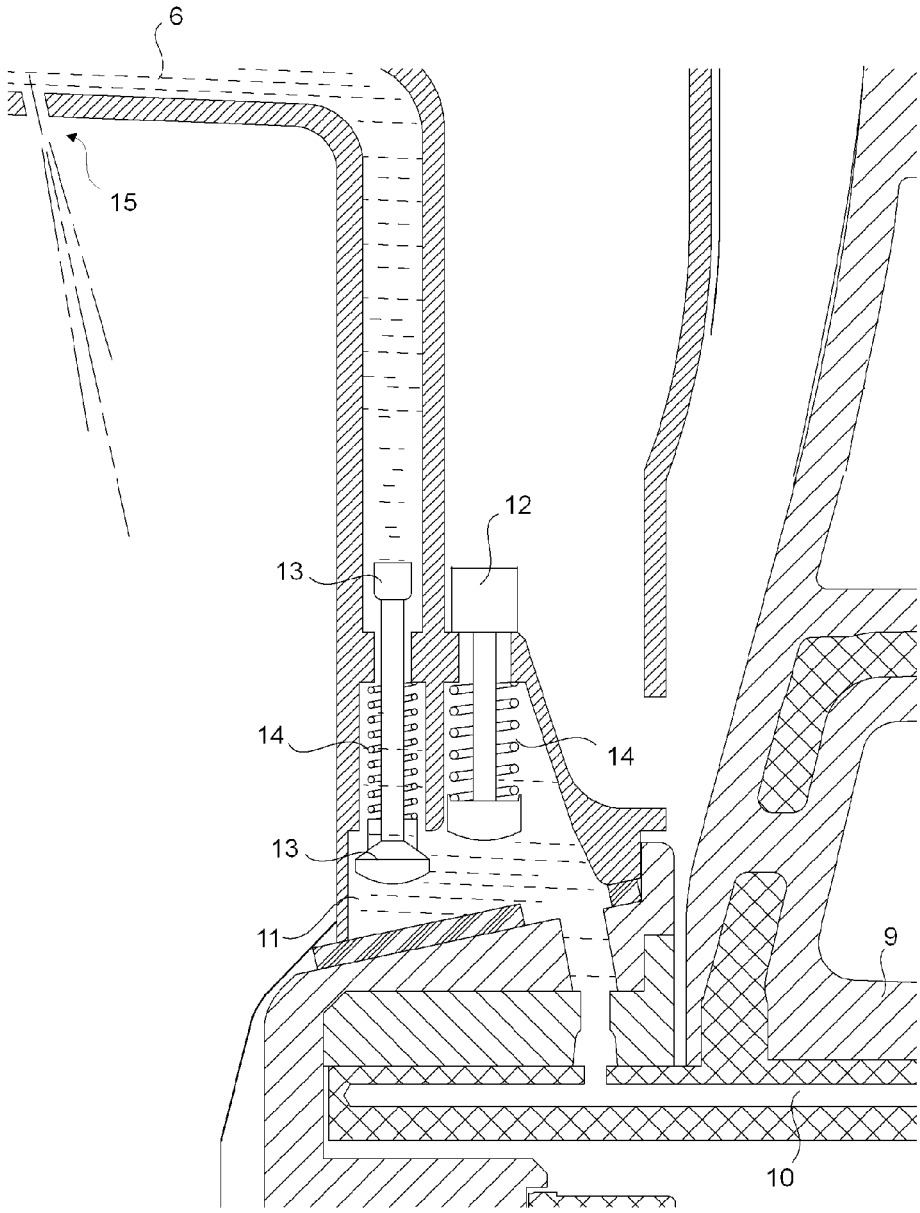

FIG. 2—is the view of detail A in FIG. 1.

Figure 3:
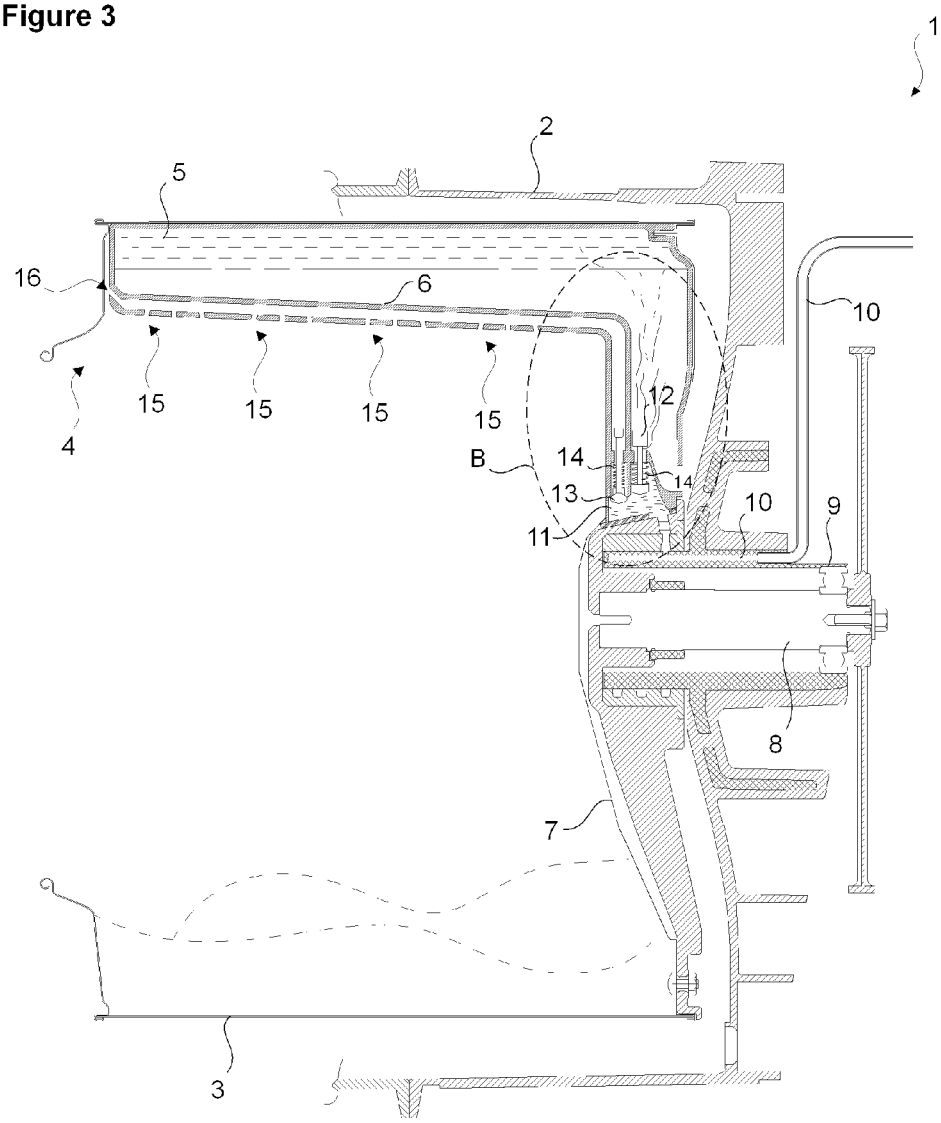

FIG. 3—is the schematic view of a washing machine while balancing process is performed in the spinning step.

Figure 4:
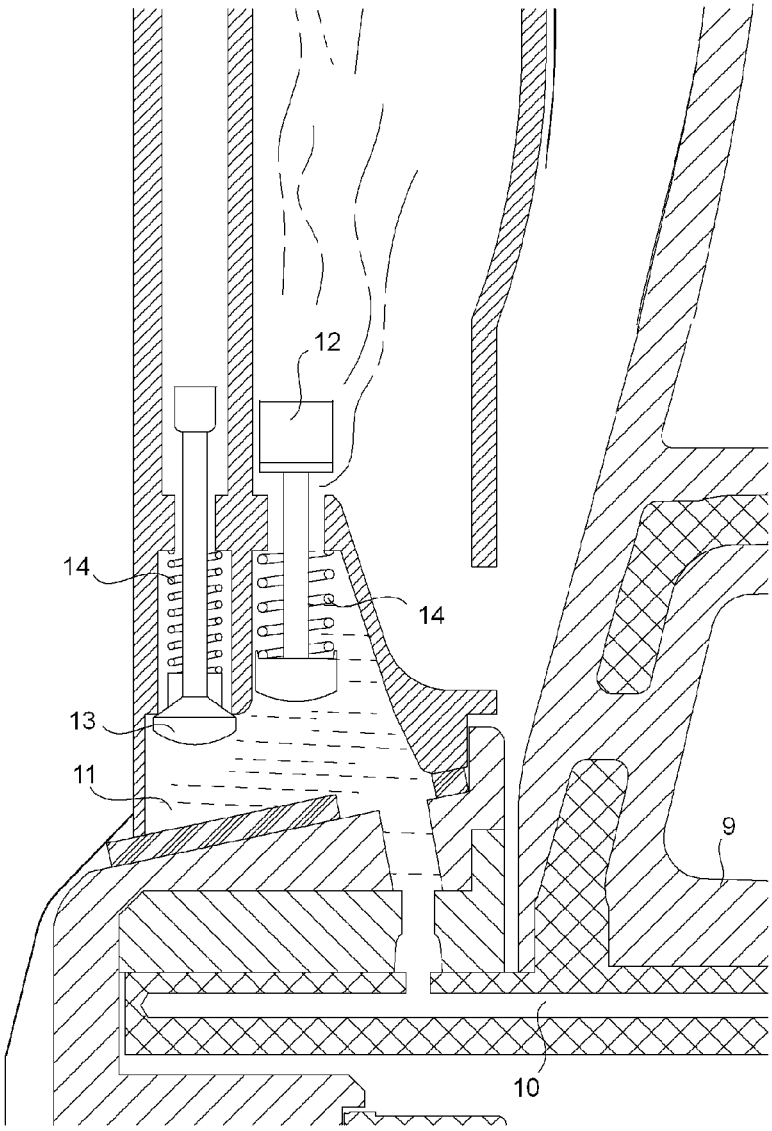

FIG. 4—is the view of detail B in FIG. 3.

The elements illustrated in the figures are numbered as follows:

1. Washing machine
2. Tub
3. Drum
4. Rib
5. Balancing reservoir
6. Showering reservoir
7. Rear wall
8. Shaft

9. Bearing
10. Feeding line
11. Distribution chamber
12. Balancing valve
13. Showering valve
14. Spring
15. Hole
16. Discharge port The washing machine (1) comprises a tub (2), a cylindrical drum (3) having a rear wall (7) wherein the items to be washed are emplaced, disposed coaxially inside the tub (2), one or more ribs (4) arranged on the inner periphery of the drum (3) and forming protrusions into the drum (3), a shaft (8) that is housed in the tub (2) and transfers the movement to the drum (3) and a bearing (9) situated at the center of the tub (2) rear wall (7), wherein the shaft (8) is housed, extending towards the center of the drum (3) and that remains stationary together with the tub (3) and at least one feeding line (10) situated inside the bearing (9) having an inlet connected to the mains supply and an outlet opening outside the bearing (9).

The ribs (4), comprising a balancing reservoir (5) wherein water from the outlet of the feeding line (10) is delivered for counterbalancing unbalanced load when load becomes unbalanced in the spinning step, and a showering reservoir (6) for delivering water unto the laundry in the drum (3) in the washing step, that are adjacent to each other and arranged parallel to each other and separated by a wall extending all along, and one or more holes (15) opening to the drum (3) facing side of the showering reservoir (6).

The rib (4), while providing the mechanical movement of the items placed inside drum (3), both the balancing process and the showering process are performed in the same rib (4) volume. Water is delivered to the showering reservoir (6) from the outlet of the feeding line (10). Accordingly, two different processes performed at different times can be provided within the rib (4) volume.

The showering reservoir (6) and the balancing reservoir (5) are adjacent to each other and extend along the rib (4) parallel to each other. A wall that extends along the rib (4) separates the showering reservoir (6) from the balancing reservoir (5). The rib (4) comprises one or more holes (15) that open to the drum (3) facing side of the showering reservoir (6). The water received into the showering reservoir (6) from the feeding line (10) during the washing step is sprayed through the holes (15) into the drum (3) by means of gravity and the water pressure.

The washing machine (1) comprises a distribution chamber (11) embedded in the rear wall (7) of the drum (3), rotating together with the drum (3), having an inlet disposed on the bearing (9) whereto the outlet of the feeding line (10) opens and two outlets disposed on an axis virtually perpendicular to the shaft (8) axis, opening to the balancing and showering reservoirs (5 and 6) remaining inside the drum (3).

The washing machine (1) comprises a balancing valve (12) that opens, closes the outlet between the distribution chamber (11) and the balancing reservoir (5) by means of gravity force and the centrifugal effect and a showering valve (13) that opens, closes the outlet between the distribution chamber (11) and the showering reservoir (6) by means of gravity force and the centrifugal effect.

The balancing valve (12)—when the rotation of the drum (3) goes above preferably 100 rpm—in the spinning step, changes to the open position by means of centrifugal effect, allowing water to flow from the distribution chamber (11) into the balancing reservoir (5). Simultaneously, that is in the spinning step the showering valve (13) is in the closed position by means of centrifugal effect. In this position, the water delivered into the distribution chamber (11) is allowed to be used only for counterbalancing the unbalanced load in the spinning step by transferring into the balancing reservoir (5).

The showering valve (13) changes to the open position in the washing step and allows water to flow into the showering reservoir (6) from the distribution chamber (11). The balancing valve (12) is closed during the washing step (12) and water received from the distribution chamber (11) is used only for the showering process.

In this embodiment, the balancing valve (12) is situated inside the balancing reservoir (5) whereas the showering valve (13) is disposed in the distribution chamber (11). The forces acting on these valves (12 and 13) in the same direction open one of the valves (12 or 13) while closing the other. Thus, while the balancing valve (12) is opening by means of centrifugal effect in the vertical direction to the rotational axis of the drum (3), the showering valve (13) is closing by means of centrifugal effect in the vertical direction to the rotational axis of the drum (3).

When the washing machine (1) is operated starting the washing step, while the drum (3) rotates with a certain speed, at the same time water is received from the feeding line (10) into the distribution chamber (11). Since the rotational speed of the drum (3) is low in the washing step, the balancing valve (12) closing the outlet to the balancing reservoir (5) is in the closed position while the showering valve (13) is in the open position. The water delivered by a certain pressure flows into the showering reservoir (6) and is sprayed through the holes (15) on the showering reservoir (6) into the drum (3) (FIG. 1 and FIG. 2).

When the spinning step starts after completion of the washing step, the centrifugal effect, increasing by the rotation of the drum (3) in high speeds, enables the balancing valve (12) to open and the showering valve (13) to close. In this position, the water flowing into the distribution chamber (11) from the feeding line (10) enters the balancing reservoir (5). Since the drum (3) rotates at high speed during the spinning step, the water in the balancing reservoir (5) collects on the wall of the balancing reservoir (5) nearest to the drum (3) periphery by means of centrifugal effect and does not leave the balancing reservoir (5) (FIG. 3 and FIG. 4).

Accordingly, the valves (12 and 13) can be controlled mechanically without requiring any electronic control means whereby the balancing and showering processes are performed within the rib (4) volume depending on the rotational speed of the drum (3).

In an embodiment of the present invention, the base of the rib (4) is configured in a partially elliptic shape having a curve matching the periphery of the drum (3) and on the side facing inside the drum (3) a pyramidal shape integrated with the elliptical shape, with the apex extending into the drum (3). The showering reservoir (6) extends inside the rib (4) and along the apex of the rib (4). The holes (15) are arranged at certain intervals on the pyramidal shape. The balancing reservoir (5) is disposed on the periphery of the drum (3) and the showering reservoir (6) is situated there-above.

In another embodiment of the present invention, the washing machine (1) comprises a spring (14), with one end fastened to the valves (12 and 13) and the other end to the outlet wherein the valves (12 and 13) is mounted, for holding the valves (12 and 13) at their initial positions. Thus, while the balancing valve (12) remains in the closed position initially by means of the spring (14), the showering valve (13) is in the open position by means of the spring (14). Consequently, the opening, closing times of the valves (12 and 13) is regulated by adjusting the spring (14) constants.

In another embodiment of the present invention, the washing machine (1) furthermore comprises at least one valve (12 and/or 13) disposed on each feeding line (10) for controllably receiving water from the main supply into the feeding line (10) and a control unit that detects unbalanced load and determines how much water is to be received into which balancing reservoir (5) by detecting the amount and position of unbalanced load thus opening or closing the valves (12 and 13) accordingly. In this embodiment of the present invention, the drum (3) comprises three ribs (4) with 120° angle therebetween, three feeding lines (10) on the bearing (9) and three distribution chambers (11) for receiving water flowing from the feeding lines (10). Thus, when water is intended to be delivered to any one balancing reservoir (5), the valve (12 or 13) on the feeding line (10) delivering water to that one opens. In addition, the washing machine (1) comprises a pump for delivering water required for the showering process to the showering reservoir (6) with a certain pressure.

In another embodiment of the present invention, the washing machine (1) comprises a discharge port (16) formed at the end of the showering reservoir (6) for discharging the water remaining in the showering reservoir (6).

By means of the present invention, in washing machines (1) wherein active balancing is performed, in other words wherein balancing is performed by delivering water to the place of unbalanced load, the volume used for the balancing process only in the spinning step is also enabled to be used for the showering process in the washing step. Thus, some portion of the volume within the rib (4) is used effectively for the balancing process and some portion is used for the showering process without requiring to utilize an additional volume in the drum (3). Moreover, in the present invention, the balancing and showering processes can be mechanically controlled without intervention of the user depending on the rotational speed of the drum (3).

The invention claimed is:

1. A washing machine (1) that comprises a tub (2), a cylindrical drum (3) having a rear wall (7) wherein the items to be washed are emplaced, disposed coaxially inside the tub (2), one or more ribs (4) arranged on the inner periphery of the drum (3) and forming protrusions into the drum (3), a shaft (8) housed on the tub (2) that transfers the movement to the drum (3) and a bearing (9) situated at the center of the tub (2) rear wall (7), remaining stationary together with the tub (3), wherein the shaft (8) is housed, extending towards the center of the drum (3) and at least one feeding line (10) situated inside the bearing (9) having an inlet connected to a mains supply and an outlet opening outside the bearing (9) and characterized by a rib (4)

having a balancing reservoir (5) wherein water from the outlet of the feeding line (10) is delivered for counterbalancing unbalanced load when load becomes unbalanced in a spinning step, and a showering reservoir (6) for delivering water unto the laundry in the drum (3) in a washing step, that are adjacent to each other and arranged parallel to each other and separated by a wall extending all along, and one or more holes (15) opening to the drum (3) facing side of the showering reservoir (6).

2. The washing machine (1) as in claim 1, characterized by a distribution chamber (11) embedded in the rear wall (7) of the drum (3), rotating together with the drum (3), having an inlet disposed on the bearing (9) whereto the outlet of the feeding line (10) opens and two outlets each disposed on an axis virtually perpendicular to the shaft (8) axis, opening to the balancing and showering reservoirs (5 and 6) remaining inside the drum (3).

3. The washing machine (1) as in claim 2, characterized by a balancing valve (12) that opens, closes the outlet between the distribution chamber (11) and the balancing reservoir (5) by means of gravity force and the centrifugal effect.

4. A washing machine (1) that comprises a tub (2), a cylindrical drum (3) having a rear wall (7) wherein the items to be washed are emplaced, disposed coaxially inside the tub (2), one or more ribs (4) arranged on the inner periphery of the drum (3) and forming protrusions into the drum (3), a shaft (8) housed on the tub (2) that transfers the movement to the drum (3) and a bearing (9) situated at the center of the tub (2) rear wall (7), remaining stationary together with the tub (3), wherein the shaft (8) is housed, extending towards the center of the drum (3) and at least one feeding line (10) situated inside the bearing (9) having an inlet connected to a mains supply and an outlet opening outside the bearing (9) and characterized by a rib (4)

having a balancing reservoir (5) wherein water from the outlet of the feeding line (10) is delivered for counterbalancing unbalanced load when load becomes unbalanced in a spinning step, and a showering reservoir (6) for delivering water unto the laundry in the drum (3) in a washing step, that are adjacent to each other and arranged parallel to each other and separated by a wall extending all along, and one or more holes (15) opening to the drum (3) facing side of the showering reservoir (6)

and characterized by a distribution chamber (11) embedded in the rear wall (7) of the drum (3), rotating together with the drum (3), having an inlet disposed on the bearing (9) whereto the outlet of the feeding line (10) opens and two outlets each disposed on an axis virtually perpendicular to the shaft (8) axis, opening to the balancing and showering reservoirs (5 and 6) remaining inside the drum (3) and characterized by a balancing valve (12) that opens, closes the outlet between the distribution chamber (11) and the balancing reservoir (5) by means of gravity force and the centrifugal effect and characterized by a showering valve (13) that opens, closes the outlet between the distribution chamber (11) and the showering reservoir (6) by means of gravity force and the centrifugal effect.

5. A washing machine (1) that comprises a tub (2), a cylindrical drum (3) having a rear wall (7) wherein the items to be washed are emplaced, disposed coaxially inside the tub (2), one or more ribs (4) arranged on the inner periphery of the drum (3) and forming protrusions into the drum (3), a shaft (8) housed on the tub (2) that transfers the movement to the drum (3) and a bearing (9) situated at the center of the tub (2) rear wall (7), remaining stationary together with the tub (3), wherein the shaft (8) is housed, extending towards the center of the drum (3) and at least one feeding line (10) situated inside the bearing (9) having an inlet connected to a mains supply and an outlet opening outside the bearing (9) and characterized by a rib (4)

having a balancing reservoir (5) wherein water from the outlet of the feeding line (10) is delivered for counterbalancing unbalanced load when load becomes unbalanced in a spinning step, and a showering reservoir (6) for delivering water unto the laundry in the drum in a washing step, that are adjacent to each other and arranged parallel to each other and separated by a wall extending all along, and one or more holes (15) opening to the drum (3) facing side of the showering reservoir (6)

and characterized by a distribution chamber (11) embedded in the rear wall (7) of the drum (3), rotating together with the drum (3), having an inlet disposed on the bearing (9) whereto the outlet of the feeding line (10) opens and two outlets each disposed on an axis virtually perpendicular to the shaft (8) axis, opening to the balancing and showering reservoirs (5 and 6) remaining inside the drum (3) and characterized by a balancing valve (12) that opens, closes the outlet between the distribution chamber (11) and the balancing reservoir (5) by means of gravity force and the centrifugal effect and characterized by a balancing valve (12) that opens by means of centrifugal effect in the spinning step, allowing water to flow from the distribution chamber (11) into the balancing reservoir (5) and a showering valve (13) that is in the closed position in the spinning step.

6. The washing machine (1) as in claim 4, characterized by a showering valve (13) that changes to the open position in the washing step allowing water to flow from the distribution chamber (11) into the showering reservoir (6) and a balancing valve (12) that is closed in the washing step.

7. The washing machine (1) as in claim 3, characterized by a balancing valve (12) that is disposed in the balancing reservoir (5).

8. The washing machine (1) as in claim 4, characterized by a showering valve (13) that is disposed in the distribution chamber (11).

9. A washing machine (1) as in claim 3, characterized by a spring (14), with one end fastened to the valve (12 and 13) and the other end to the outlet wherein the valve (12 and 13) is mounted, for holding the valves (12 and 13) at their initial positions.

10. A washing machine (1) as in claim 1, characterized by a discharge port (16) formed at the end of the showering reservoir (6) for discharging the water remaining in the showering reservoir (6).

11. The washing machine (1) as in claim 4, characterized by a spring (14), with one end fastened to the valve (12 and 13) and the other end to the outlet wherein the valve (12 and 13) is mounted, for holding the valves (12 and 13) at their initial positions.

12. The washing machine (1) as in claim 2, characterized by a discharge port (16) formed at the end of the showering reservoir (6) for discharging the water remaining in the showering reservoir (6).

13. The washing machine (1) as in claim 3, characterized by a discharge port (16) formed at the end of the showering reservoir (6) for discharging the water remaining in the showering reservoir (6).

14. The washing machine (1) as in claim 4, characterized by a discharge port (16) formed at the end of the showering reservoir (6) for discharging the water remaining in the showering reservoir (6).

15. The washing machine (1) as in claim 5, characterized by a discharge port (16) formed at the end of the showering reservoir (6) for discharging the water remaining in the showering reservoir (6).

16. The washing machine (1) as in claim 6, characterized by a discharge port (16) formed at the end of the showering reservoir (6) for discharging the water remaining in the showering reservoir (6).

17. The washing machine (1) as in claim 7, characterized by a discharge port (16) formed at the end of the showering reservoir (6) for discharging the water remaining in the showering reservoir (6).

18. The washing machine (1) as in claim 8, characterized by a discharge port (16) formed at the end of the showering reservoir (6) for discharging the water remaining in the showering reservoir (6).

19. The washing machine (1) as in claim 9, characterized by a discharge port (16) formed at the end of the showering reservoir (6) for discharging the water remaining in the showering reservoir (6).

20. The washing machine (1) as in claim 11, characterized by a discharge port (16) formed at the end of the showering reservoir (6) for discharging the water remaining in the showering reservoir (6).

* * * * *